US005958853A

United States Patent [19]

Watanabe

[11] Patent Number: 5,958,853

[45] Date of Patent: Sep. 28, 1999

[54] SOLID, WATER-DEGRADABLE DISINFECTANT AND CLEANSER COMPOSITION, AND ASSOCIATED METHODS OF MANUFACTURE AND USE

[75] Inventor: Erika Watanabe, Oakland, Calif.

[73] Assignee: The Clorox Company, Oakland, Calif.

[21] Appl. No.: 09/032,360

[22] Filed: Feb. 27, 1998

Related U.S. Application Data

[63] Continuation of application No. 08/863,899, May 27, 1997.

[51] Int. Cl.[6] ..... C11D 3/48; C11D 17/00; C11D 3/395

[52] U.S. Cl. ..... 510/192; 510/191; 510/367; 510/379; 510/382; 510/389; 510/481

[58] Field of Search ..... 510/192, 191, 510/484, 491, 495, 193, 108, 367, 379, 380, 381, 382, 389, 390, 481

[56] References Cited

U.S. PATENT DOCUMENTS

| | | | |
|---|---|---|---|
| 4,119,578 | 10/1978 | Daeninckx et al. | 252/548 |
| 4,269,723 | 5/1981 | Barford et al. | 252/106 |
| 4,427,692 | 1/1984 | Girard . | |
| 4,460,490 | 7/1984 | Barford et al. . | |
| 4,537,697 | 8/1985 | Girard . | |
| 4,683,072 | 7/1987 | Holdt et al. | 252/102 |
| 4,741,853 | 5/1988 | Walker et al. . | |
| 4,800,066 | 1/1989 | Sinclair et al. | 422/55 |
| 4,852,201 | 8/1989 | Wundrock et al. . | |
| 5,205,955 | 4/1993 | Bunczk et al. | 252/102 |
| 5,284,598 | 2/1994 | Subramanyam | 252/121 |

FOREIGN PATENT DOCUMENTS

| | | |
|---|---|---|
| 0 206 725 | 12/1986 | European Pat. Off. . |
| WO 94/26863 | 11/1994 | WIPO . |

*Primary Examiner*—Yogendra Gupta
*Assistant Examiner*—Gregory E Webb
*Attorney, Agent, or Firm*—Dianne E. Reed; Reed & Associates

[57] ABSTRACT

A disinfectant and cleansing composition is provided in the form of an extruded solid. The active agent in the composition is a halogen-releasing agent such as a halogenated 5,5-dialylhydantoin. An inert binder such as a fatty acid salt or a hectoritic clay is used to enable manufacture of the composition using an extrusion process. Fragrance, colorants, and other pressure-sensitive materials may be included; fragrance and colorants are preferably incorporated in encapsulated form. Methods for manufacturing the compositions are also provided, as are methods for using the compositions in sanitizing water, particularly in disinfecting and cleansing flush toilets.

26 Claims, No Drawings

SOLID, WATER-DEGRADABLE DISINFECTANT AND CLEANSER COMPOSITION, AND ASSOCIATED METHODS OF MANUFACTURE AND USE

CROSS-REFERENCE TO RELATED APPLICATION

This is a continuation of U.S. patent application Ser. No. 08/863,899, filed May 27, 1997.

TECHNICAL FIELD

The present invention relates generally to disinfectant and cleanser compositions. More particularly, the invention relates to a novel disinfectant and cleanser composition in the form of a water-degradable solid, i.e., a tablet, block, or the like, to a method of manufacturing such a composition using an extrusion process, and to a methods of using the composition to sanitize water. A specific application of the novel composition is in cleaning and disinfecting flush toilets.

BACKGROUND

Solid compositions useful as disinfectants and cleansers are well known in a number of contexts, i.e., as detergents, bleaches, and the like. Toilet cleaner and disinfectant compositions in the form of solid tablets and "cleansing blocks" have also been described, for example, in U.S. Pat. No. 4,683,072 to Holdt et al. and U.S. Pat. No. 4,460,490 to Barford et al., respectively. As explained in Holdt et al., cleaning and disinfectant tablets used to sanitize toilet bowls contain numerous components such as bleaches, germicides and other disinfectants, salts, acids, complexes, disintegration rate regulators, plasticizers, and the like. Barford et al., similarly, describes cleansing compositions for toilets, the compositions containing a number of different types of ingredients, including bleaching agents, dyes, fillers, water softeners, anionic surfactants, and the like. Solid disinfectant and cleansing compositions are also described in U.S. Pat. No. 4,741,853 to Walker et al. and U.S. Pat. No. 5,110,868 to Bellis et al., both of which focus on the controlled release of the chemicals contained in the sanitizing blocks.

As the components of these compositions can be quite corrosive, it has proven difficult to prepare a stable, long-lasting formulations. This is especially true with compositions containing halogen-releasing agents, particularly hypohalite-releasing agents such as the hypochlorite- and hypobromite-releasing bleaches. Halogen-releasing agent are frequently viewed as preferable to other types of halogenating or oxidizing agents, particularly in sanitizing applications or in other contexts where powerful cleansing agents are required. However, the fact that halogen-releasing agents are such strong oxidizing agents can cause problems with stability and shelf-life.

Furthermore, the reactivity of halogen-releasing agents has made it difficult to incorporate chemically sensitive components which would otherwise be desirable, e.g., aesthetic additives such as fragrance and colorant. European Patent Publication No. 206,725 ("Lavatory Cleansing Compositions"), inventors Barford et al., notes the importance of excluding any components from a solid bleach composition which would be susceptible to degradation by the extremely reactive halogen-releasing agents used, e.g., halogenated dialkylhydantoins. For this reason, several products are currently marketed as "two-tablet" systems, with one tablet containing bleach and the second tablet containing a colorant.

In addition, halogenated derivatives of dialkylhydantoins such as dimethylhydantoin are very fine, dusty powders which are difficult to compact into solid, high integrity forms such as compressed tablets or blocks. Thus, the manufacture of hydantoin blocks and tablets has proved problematic. There is not, at present, a completely acceptable way of manufacturing solid disinfectant and cleansing compositions containing a halogen-releasing agent such as a hydantoin, i.e., a method which involves simple and straightforward technology and provides a chemically and physically stable product. The currently used processes for manufacturing solid disinfectant and cleansing compositions involve the need for compaction, granulation, or the like, and the associated manufacturing and control systems. UK Patent Publication No. 2,276,345A ("Process for Making Shaped Articles"), inventor Adams, describes such a process, which involves compacting and molding detergent compositions into finished "shaped articles." European Patent Publication No. 206,725, cited above, describes an extrusion process for making solid hydantoin tablets which requires significant quantities of anionic surfactant (the exemplified formulations contain 32 wt. % to 58 wt. % anionic surfactant). The compositions do not incorporate any potentially bleach-sensitive perfumes, dyes, or the like.

Accordingly, there remains a need in the art for a solid disinfectant and cleansing composition which is stable and long-lasting, can contain chemically sensitive components such as fragrance and colorant in addition to a halogen-releasing agent, and is readily manufactured using a simple extrusion process. Extrusion provides for a number of advantages relative to conventional tabletting processes. One such advantage is an increase in the uniformity of the composition; tabletting, in contrast to extrusion, can result in particle segregation. An additional advantage, as alluded to above, is the use of a lower pressure process, which enables incorporation of pressure-sensitive materials such as encapsulates and the like. Still an additional advantage is the capability of adding liquid materials to the composition during the extrusion process, something that is not feasible with conventional tabletting methods.

SUMMARY OF THE INVENTION

The present invention now provides a stable, long-lasting disinfectant and cleansing composition which can be manufactured using an extrusion process, contains a halogen-releasing agent as the active compound, and is scented and potentially colored as well. The extrusion method used to make the compositions is a lower pressure process than involved in with conventional compaction techniques, facilitating incorporation of encapsulated materials (e.g., encapsulated fragrances or colorants) and/or other pressure-sensitive materials. Extrusion also provides for a composition that is substantially uniform, and, further, enables the composition to be manufactured in a variety of different sizes and shapes, in turn facilitating the elimination of "stress points" such as edges and corners.

Accordingly, it is a primary object of the present invention to provide a novel disinfectant and cleansing composition in the form of a water-degradable solid block or tablet, wherein the composition contains (a) a halogen-releasing agent as the active agent, (b) fragrance and/or colorant, and (c) an inert binder which enables the composition to be made using an extrusion process.

It is another object of the invention to provide such a composition in the form of a hydantoin-based tablet containing fragrance and/or colorant.

It is another object of the invention to provide such a composition in the form of a scented dihalodialkylhydantoin-based tablet.

It is another object of the invention to provide a method of manufacturing a solid disinfectant and cleansing composition by extruding a mixture of a halogen-releasing agent, fragrance and/or colorant, an inert binder, and, optionally, other components such as lubricants, solubility control agents, water-softening agents, preservatives, or the like.

It is yet another object of the invention to provide such a method which further involves cutting the extrudate obtained into tablets or blocks.

It is a further object of the invention to provide a method for sanitizing a volume of water by immersing the cleansing tablet into the water to be sanitized, and maintaining the tablet in the water for a period of time sufficient to ensure that the volume of water is suitably disinfected and cleansed.

It is still a further object of the invention to provide a method for disinfecting and cleansing a flush toilet by immersing the novel composition in the bowl or tank of the toilet, or by mounting a dispensing device containing the composition in the path of flushing water.

Additional objects, advantages and novel features of the invention will be set forth in part in the description which follows, and in part will become apparent to those skilled in the art upon examination of the following, or may be learned by practice of the invention.

DETAILED DESCRIPTION OF THE INVENTION

It is to be understood that this invention is not limited to specific halogen-releasing agents, binders, manufacturing process parameters, or the like, as such may vary. It is also to be understood that the terminology used herein is for the purpose of describing particular embodiments only and is not intended to be limiting. It must be noted that, as used in the specification and the appended claims, the singular forms "a," "an" and "the" include plural referents unless the context clearly dictates otherwise. Thus, reference to "a halogen-releasing agent" includes mixtures of such agents, reference to "a binder" includes mixtures of binders, and the like.

In this specification and in the claims which follow, reference will be made to a number of terms which shall be defined to have the following meanings:

The terms "tablet" and "block" are used interchangeably to refer to a shaped solid form; the terms are not intended to be limiting with respect to the shape or size of the composition. As will be appreciated by those skilled in the art, the shape or size of the solid form may vary. Larger blocks may be preferred in some applications, as they are longer lasting and can thus be replaced less frequently.

A "halogen-releasing agent" as used herein refers to compounds which release halogen compounds upon contact with water; typically, although not necessarily, the halogen-releasing agents are hypohalite-releasing agents, i.e., agents which release hypochlorite or hypobromite ions upon reaction with water.

The term "halogen" is used in its conventional sense to refer to chlorine, bromine, fluorine or iodine; generally, the "halogen" substituents herein are chlorine or bromine.

The term "alkyl" refers to a branched or unbranched saturated hydrocarbon group of 1 to 12 carbon atoms, such as methyl, ethyl, n-propyl, isopropyl, n-butyl, isobutyl, t-butyl, octyl, decyl, tetradecyl, and the like, and can include cycloalkyl groups such as cyclopentyl and cyclohexyl. Preferred alkyl groups herein are "lower alkyl" groups; by "lower alkyl" is meant an alkyl group of one to six carbon atoms, preferably one to four carbon atoms.

The term "optional" as used herein, as in the recitation that the presence of a particular component in the composition is "optional," means that the component may or may not be present, and includes instances where the component is present and instances where the component is not present.

By the term "effective amount" as used to refer to the amount of a particular component in a composition is meant a sufficient amount of the component to provide the desired effect. For example, when referring to an "effective amount" of a colorant in the composition, it is meant that the component is present in an amount sufficient to provide the desired color.

The active disinfectant and cleansing component in the novel compositions is a halogen-releasing agent. As will be appreciated by those skilled in the art, any number of halogen-releasing agents may be used herein, and the choice of a specific agent can be determined using routine methods. Suitable halogen-releasing agents include, but are not limited to: chloramines; chlorimines; chloramides; chlorimides; halogenated isocyanurates, including heterocyclic N-bromo and N-chloro cyanurates; halogenated melamines such as N,N,N-trichloromelamine; N-chlorosuccinimide; alkali metal or alkaline earth metal hypochlorites, e.g., calcium hypochlorite and lithium hypochlorite; halogenated phthalamides such as N-chloro-phthalamide and N-bromophthalamide; and halogenated hydantoins, particularly halogenated 5,5-dialkyl-substituted hydantoins.

Preferred hydantoins within the aforementioned group are substituted on one or both of the nitrogen atoms of the imidazolidinedione ring with a chloro or bromo substituent. Structurally, such compounds may be represented by formula (I)

(I)

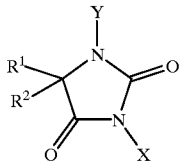

wherein $R^1$ and $R^2$ are each lower alkyl, i.e., $C_1$–$C_6$ alkyl, preferably $C_1$–$C_4$ alkyl, and may be the same or different, and X and Y are halogen substituents. $R^1$ and $R^2$ may be, for example, methyl, ethyl, propyl, isobutyl, t-butyl, or the like. Examples of such compounds include 1-bromo-3-chloro-5,5-dimethylhydantoin, 1,3-dichloro-5,5-dimethylhydantoin, 1,3-dibromo-5,5-dimethylhydantoin, 1-bromo-3-chloro-5,5-diethylhydantoin, 1,3-dichloro-5,5-diethylhydantoin, 1,3-dibromo-5,5-diethylhydantoin, 1-bromo-3-chloro-5-methyl-5-ethylhydantoin, 1,3-dichloro-5-methyl-5-ethylhydantoin, 1,3-dibromo-5-methyl-5-ethylhydantoin, 1-bromo-3-chloro-5-methyl-5-n-propylhydantoin, 1,3-dichloro-5-methyl-5-n-propylhydantoin, 1,3-dibromo-5-methyl-5-n-propylhydantoin, and the like. Such compounds may be obtained commercially (for example, 1,3-dichloro-5,5-dimethylhydantoin may be obtained from Lonza (Fair Lawn, N.J.) under the trade name Dantochlor®) or they may be readily synthesized using techniques known to those skilled in the art of synthetic organic chemistry, and/or processes described in the pertinent literature (see, e.g., U.S. Pat. No. 4,537,697, which shows the halogenation of a 5,5-dialkylhydantoin using HOBr or HOCl; see also U.S. Pat. No. 2,828,308 to Lorenz, Biltz, *J. Prakt. Chem.* 113:248 (1926), and Orazi, *Annales Asoc. Quim. Argentina* 41:153 (1953)).

In particularly preferred compounds, the substituents of formula (I) are as follows: one of $R^1$ and $R^2$ is methyl; the other of $R^1$ and $R^2$ is either methyl or ethyl; X is chlorine; and Y is either chlorine or bromine. Such compounds include 1,3-dichloro-5,5-dimethylhydantoin, 1,3-dichloro-5-methyl-5-ethylhydantoin, 1-bromo-3-chloro-5,5-dimethylhydantoin, and 1-bromo-3-chloro-5-methyl-5-ethylhydantoin. Oxidation of such compounds releases either a hypochlorite or a hypobromite ion, depending on how the hydantoin molecule is substituted.

The inert binder used and the quantity included in the composition are such that the composition can be prepared using an extrusion technique. Suitable binders include, but are not limited to, fatty acid salts and clays.

By "fatty acid salt" is meant a salt of a fatty acid having the formula $CH_3(CH_2)COOH$, wherein n is an integer in the range of 6–20 inclusive, and is typically in the range of 8–16. For use as the binder herein, preferred fatty acid salts are alkali metal salts of fatty acids; examples of such compounds include sodium stearate and sodium myristate.

The term "clay" is used to refer to amorphous or crystalline compositions comprised of minerals, and which exist in nature as a composition containing very fine crystals or particles; clays are predominantly comprised of hydrated silicates of aluminum, iron or magnesium. Preferred clays for use herein as the inert binder are hectoritic clays, with laponite clays particularly preferred. Such clays are commercially available, for example, from Southern Clay Products, Inc. (Gonzales, Tex.). Laponites are synthetic hectorite clays containing magnesium, lithium, silica, oxygen, hydrogen, and sodium, and like other clays, are composed in the dry state of plateletes arranged in stacks. Each platelet has a double layer of tetrahedral silica bonded to oxygen atoms; between the two silica layers is a sheet of magnesium an dlithium in a 5.3:0.7 ratio, which coordinate the inner row of silica-bound oxygen atoms and OH groups. The partial substitution of the magnesium and lithium cations imparts an overall negative charge to the silica surface, and the presence of incompletely complexed cations impart a positive charge on the edges of the platelet. When in contact with water, the anionic silica faces and the cationic edges electrostatically attract each other, forming what is know as a "card house" matrix which is easily disrupted by shear stress. This structure formation and disruption by shear stress means that laponite clay dispersions have marked thixotropic properties that make them attractive as thickening agents which are also chemically inert.

The discovery that clays and fatty acid salts can serve as inert binders in solid bleach compositions, and enable extrusion of a hydantoin-containing mixture containing chemically sensitive or pressure-sensitive materials, is an important one. As explained above, the art does not disclose or suggest extruded hydantoin compositions containing fragrance, colorant, and/or other bleach-sensitive or pressure-sensitive materials.

When a clay such as laponite clay is used as the binder, it is actually prepared as an aqueous composition first, and then incorporated as such into the extrusion mixture. Then aqueous composition is generally a dispersion containing approximately 1 wt. % to 10 wt. % clay.

It is also desirable, although not essential, that the composition contain a lubricant. A suitable lubricant used in an appropriate amount can facilitate the extrusion process and provide for a finished product having a relatively smooth surface. Generally, the lubricant will be a fatty acid salt, including divalent fatty acid salts such as magnesium stearate, calcium stearate, and the like. Boric acid can also serve as a lubricant, as can other conventional solid lubricants, as will be appreciated by those skilled in the art.

The composition also contains a fragrance, preferably, although not necessarily, in encapsulated form. The particle size of the capsule is normally in the range of about 1 $\mu$m to about 1 mm, preferably in the range of about 50 $\mu$m to about 150 $\mu$m. The material used to encapsulate the fragrance is selected so as to be substantially inert with respect to the halogen-releasing agent, but will dissolve when placed in water. A wide variety of materials may serve to encapsulate the fragrance. Examples of suitable encapsulating materials are polyethylene waxes, polyvinyl acetate, polyvinyl pyrrolidone, polyamides, polyesters, and homo- and co-polymers formed from monomers such as acrylic acid, methacrylic acid, maleic acid, fumaric acid, itaconic acid, etc. Examples of suitable natural substances that may be used are polysaccharides, gelatin, gum acacia and arabic, carboxymethyl cellulose, ethyl cellulose, hydroxyalkyl cellulose, alkyl cellulose and natural waxes. Generally, the encapsulating material will represent about 10 wt. % to 80 wt. % of the fragrance "capsule."

In an alternative embodiment, the fragrance is not encapsulated within the composition. Rather, it is selected so as to be substantially inert with respect to the halogen-releasing agent. Such fragrances are commercially available, for example: product nos. 1002-HV, 5747-AG, 6198-AG-1 and 6346-HAY, from International Flavors and Fragrances (Hazlet, N.J.); product nos. EC137, Q12917 and Q17035-1, from Quest International (Mount Olive, N.J.); product no. T5464, from Givaudan-Roure Corporation (Clifton, N.J.); and product no. SZ4890, from J. & E. Sozio Incorporated (Kenilworth, N.J.). Also, as explained earlier herein, use of the present extrusion process enables incorporation of liquid materials into the final product; thus, fragrances can, if desired, be added in liquid form.

The fragrance itself may be any compound or composition which imparts an acceptable odor to the water being treated, and may include, for example: essential oils such as lemon oil; extracts such as pine extract; and terpene hydrocarbons such as terpene alcohols (verbenol, transpinocarveol, cis-2-pinanol, etc.), terpene ethers and esters (e.g., 1,8-cineole, 1,4-cineole, isobornyl methyl ether, rose pyran, etc.), and terpene aldehydes and ketones (e.g., myrtenal, campholenic aldehyde, citronellal, citral, etc.).

It is also desirable that the composition include a colorant such as a pigment or dye. Dyes are preferred; examples of suitable dyes include FD & C Blue No. 1, Ultramarine Blue, Copper Phthalocyanine, Acid Blue No. 9, Carta Blue V (C.I. 24401), Acid Green 2G (C.I. 42085), Astragon Green D (C.I. 42040), Maxilon Blue 3RL (C.I. Basic Blue 80), Drimarine Blue Z-RL (C.I. Reactive Blue 18) and other Acid Blue 9 type dyes. If a colorant is included, it should be encapsulated in a material which is inert with respect to the halogen-releasing agent, but, as described for the fragrance-encapsulating material, should dissolve when the composition is introduced into water. The materials used to encapsulate the colorant may be selected from the same materials chosen to encapsulate the fragrance; however, as the fragrance material is typically oil-based, while the colorant is typically a water-soluble dye, different coating materials are normally used for the two components. That is, a hydrophobic material compatible with an oil-based component is generally used as a protective coating for the fragrance, while a hydrophilic material is typically preferred to coat the colorant.

The protective coating for the fragrance and/or colorant may be formed using conventional coating, encapsulation and/or coacervation techniques known to those skilled in the art or described in the pertinent literature. For example, the coating may be applied by spraying a solution or emulsion of the encapsulating material into the air inlet stream of a fluidized bed comprising the fragrance or colorant particles to be encapsulated. Other techniques, of course, may be used. Alternatively, encapsulated fragrances and encapsulated colorants may be obtained commercially, as from the Ronald T. Dodge Company.

The composition may also include solubility control agents, water-softening agents, germicides, preservatives, flow aids, water, water-soluble fillers, corrosion inhibitors, and the like. Water-softening agents are generally water-soluble salts of a polyvalent metal, such as, for example, calcium sulfate and magnesium sulfate. Germicides and preservatives may be included if desired, but are generally unnecessary because the halogen-releasing agent itself acts as a germicide.

The solid compositions of the invention are formed using an extrusion process. First, the halogen-releasing agent, generally in particulate form, is mixed with the fragrance, the inert binder, any other components to be incorporated into the composition, e.g., a lubricant, encapsulated colorant, etc., and water. The relative quantities of the components in this mixture are as follows: approximately 70 wt. % to 99 wt. %, preferably 75 wt. % to 95 wt. %, and most preferably 80 wt. % to 95 wt. % halogen-releasing agent; approximately 1 wt. % to 15 wt. %, preferably 2 wt. % to 10 wt. %, and most preferably 2 wt. % to 8 wt. % binder (with clay binders, these percentages represent the percentage of a binder-water composition in the extrusion mixture); approximately 1 wt. % to 15 wt. %, preferably 2 wt. % to 10 wt. %, fragrance; and, optionally, 10 approximately 0.5 wt. % to 10 wt. %, preferably 0.5 wt. % to 5 wt. %, lubricant. Generally, using 70 wt. % halogen-releasing agent in the extrusion mixture will give rise to a final product containing on the order of 75 wt. % of the agent (i.e., after drying), while use of 95 wt. % halogen-releasing agent in the extrusion mixture will provide for a final product containing on the order of 99 wt. % halogen-releasing agent or more.

The initial mixing step may involve combining all components simultaneously, or it may involve separately mixing the dry components, and the liquid components; alternatively, the various components may, simply, be added one at a time. The mixture is then introduced into an extruder at a suitable rate (as a blend of the dry and liquid mixtures, or with the dry and liquid mixtures fed separately), wherein temperatures are maintained in the range of approximately 30° F. to 120° F., preferably 50° F. to 100° F. The product is extruded using a suitable pressure, typically in the range of approximately 20 to 1000 psi, preferably 50 to 350 psi. The extrudate is then cut into shaped forms as desired, and the products so prepared are then air-dried.

In use, the solid composition may be used as a "drop-in" cleanser, as a free-standing block in the toilet bowl or tank, or as a "rim block" mounted under the rim of a toilet bowl, so as to come into contact with flushing water. Alternatively, the composition may be incorporated into a dispenser designed to be placed in the tank reservoir which delivers water to the toilet bowl. The compositions of the invention may also be used in other types of applications wherein it is desired to sanitize a volume of water, e.g., in disinfecting swimming pools, spa water, and the like.

It is to be understood that while the invention has been described in conjunction with the preferred specific embodiments thereof, the description above and the examples which follow are intended to illustrate and not limit the scope of the invention. Other aspects, advantages and modifications within the scope of the invention will be apparent to those skilled in the art to which the invention pertains.

All patents, patent applications, and other publications cited herein are incorporated by reference in their entireties.

Experimental

The following examples are put forth so as to provide those of ordinary skill in the art with a complete disclosure and description of how to make the compositions of the invention. Efforts have been made to ensure accuracy with respect to numbers (e.g., amounts, temperature, etc.) but some errors and deviations should be accounted for.

Materials were obtained as follows: Dantochlor®, from Lonza (Fair Lawn, N.J.); sodium stearate, from Acme-Hardesty (Jenkintown, Pa.); laponite clay, from Southern Clay Products Gonzales, Tex.; encapsulated fragrance (Apple Floral Fragrance Q-12917, Quest International, Mount Olive, N.J.), from the Ronald T. Dodge Company (Dayton, Ohio).

EXAMPLE 1

A hydantoin tablet containing 94 wt. % Dantochlor® powder (about 86% 1,3-dichloro-5,5-dimethylhydantoin) and 6.0 wt. % of an inert binder, comprising a 5 wt. % solution of laponite, was prepared as follows.

The Dantochlor® was blended in 15–25 pound batches using a solids mixer. Laponite solutions (5 wt. %) were prepared in 1000–5000 gram batches by mixing Laponite RDS and DI water with a Lightnin Labmaster Model L1408F agitator/mixer. Both dry and liquid ingredients were fed directly into a 2" extruder's feed hopper. The dry ingredients were fed by hand at a rate of approximately 750 g/min. Liquid ingredients (laponite solution) were metered at varying rates (25–100 g/min) using a peristaltic pump with ¼" tubing (Masterflex Model #7518-10). Product temperatures generally ranged from 80° F. to 90° F., and the pressure at the end of the extruder barrel ranged from 50 to 350 psi. A round aluminum extruder die (2" i.d.) was used. The extrudate was cut into tablets, and then air-dried to produce finished tablets.

EXAMPLE 2

The process of Example 1 was repeated, except that the binder was comprised of a 2 wt. % laponite solution instead of a 5 wt. % laponite solution.

EXAMPLE 3

The process of Example 1 was repeated, except that the laponite binder was replaced with sodium stearate and water, respectively representing 5 wt. % and 4 wt. % of the composition prior to drying.

EXAMPLE 4

The process of Example 1 was repeated, except that the laponite binder was replaced with sodium stearate and water, respectively representing 10 wt. % and 6 wt. % of the final composition prior to drying.

EXAMPLE 5

The process of Example 1 was repeated, except that the binder used contained a 2 wt. % laponite solution and sodium stearate (the laponite solution and the sodium stearate respectively representing 6 wt. % and 7.5 wt. % of the composition, prior to drying).

EXAMPLE 6

The process of Example 1 was repeated, except that the laponite binder was replaced with sodium stearate and water, respectively representing 7.5 wt. % and 6 wt. % of the final composition, prior to drying. Also, a 1¼" square die was used to form the tablet and add pressure, instead of the round die used in Example 1.

EXAMPLE 7

The process of Example 1 was repeated, except that the binder used contained a 2 wt. % laponite solution and sodium stearate (the laponite solution representing 3 wt. % of the composition and the sodium stearate representing 7.5 wt. % of the composition, prior to drying). Also, a 1¼" square die was used to form the tablet and add pressure, instead of the round die used in Example 1.

EXAMPLE 8

The process of Example 1 was repeated, except that the binder used contained a 5 wt. % laponite solution and sodium stearate (respectively representing 3 wt. % and 7.5 wt. % of the composition, prior to drying). Also, encapsulated fragrance (5 wt. %) was incorporated into the composition, and a 1¼" square die was used to form the tablet and add pressure, instead of the round die used in Example 1.

Product evaluation: The finished tablets of Examples 1 through 8 were evaluated for processability (tablet smoothness and texture, process consistency), integrity in water at 70° F. (whether or not the general tablet shape was maintained), and flush performance (fragrance and/or bleach odor when flushed, longevity). All of the products prepared were uniform and smooth, and maintained their integrity in water at 70° F., even after four months. 100-gram tablets were flush-tested by placement in separate toilet tanks that were flushed repeatedly and found to maintain their integrity; the tablet of Example 8 produced a detectable fragrance upon flushing.

We claim:

1. A composition for disinfecting and cleansing a volume of water, comprising an extruded solid of an admixture of: a halogen-substituted 5,5-dialkylhydantoin; an inert binder; and fragrance, wherein the halogen-substituted 5,5-dialkylhydantoin represents approximately 70 wt. % to 99 wt. % of the composition.

2. The composition of claim 1, wherein the halogen-substituted 5,5-dialkylhydantoin has the structural formula (I)

(I)

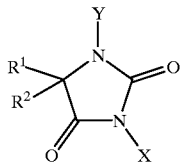

wherein $R^1$ and $R^2$ are independently selected from the group consisting of $C_1$–$C_6$ alkyl substituents, and X and Y are halogen.

3. The composition of claim 2, wherein the halogen-substituted 5,5-dialkylhydantoin is selected from the group consisting of 1,3-dichloro-5,5-dimethylhydantoin, 1,3-dichloro-5-methyl-5-ethylhydantoin, 1-bromo-3-chloro-5,5-dimethylhydantoin, and 1-bromo-3-chloro-5-methyl-5-ethylhydantoin.

4. The composition of claim 3, wherein the halogen-substituted 5,5-dialkylhydantoin is 1,3-dichloro-5,5-dimethylhydantoin.

5. The composition of claim 1, wherein the inert binder is selected so as to enable preparation of the composition by extrusion.

6. The composition of claim 5, wherein the inert binder is selected from the group consisting of fatty acid salts and clays.

7. The composition of claim 6, wherein the inert binder is an alkali metal salt of a fatty acid having the structural formula $CH_3(CH_2)_nCOOH$, wherein n is an integer in the range of 6 to 20 inclusive.

8. The composition of claim 7, wherein n is an integer in the range of 8 to 16 inclusive.

9. The composition of claim 8, wherein the fatty acid salt is sodium stearate.

10. The composition of claim 8, wherein the fatty acid salt is sodium stearate.

11. The composition of claim 6, wherein the inert binder is comprised of a clay.

12. The composition of claim 11, wherein the clay is a hectoritic clay.

13. The composition of claim 12, wherein the hectoritic clay is laponite clay.

14. The composition of claim 1, wherein the fragrance is present in encapsulated form.

15. The composition of claim 1, further including a colorant.

16. The composition of claim 15, wherein the colorant is present in encapsulated form.

17. The composition of claim 15, wherein the colorant is a dye.

18. The composition of claim 1, further including an effective amount of a lubricant.

19. The composition of claim 18, wherein the lubricant is sodium stearate.

20. The composition of claim 1, further including a water-softening agent.

21. A method for sanitizing a volume of water, comprising immersing the composition of claim 1 into the water and maintaining the composition therein for a period of time effective to provide for disinfecting of the water.

22. A method for disinfecting and cleansing a flush toilet, comprising adding to the bowl the composition of claim 1.

23. A method for disinfecting and cleansing a flush toilet having a tank reservoir, comprising adding to the reservoir the composition of claim 1.

24. The method of claim 23, wherein the composition is present in a dispensing device.

25. A method for disinfecting and cleansing a flush toilet, comprising placing the composition of claim 1 in the path of flushing water.

26. The method of claim 25, wherein the composition is present in a dispensing device.

* * * * *

UNITED STATES PATENT AND TRADEMARK OFFICE

CERTIFICATE OF CORRECTION

PATENT NO. : 5,958,853

DATED : September 28, 1999

INVENTOR(S) : Erika Watanabe

It is certified that error appears in the above-identified patent and that said Letters Patent is hereby corrected as shown below:

On the title page, item [75]:

Please correct the Inventor name from "Erika Watanabe, Oakland, Calif." to --Erika Watanabe, Oakland, Calif. and Vincent N. DeMaso, San Ramon, Calif --.

Signed and Sealed this

Twenty-eighth Day of December, 1999

*Attest:*

Q. TODD DICKINSON

*Attesting Officer*

*Acting Commissioner of Patents and Trademarks*